US005158383A

United States Patent [19]

Glover et al.

[11] Patent Number: 5,158,383

[45] Date of Patent: Oct. 27, 1992

[54] PASTE DISPENSING BRUSH

[75] Inventors: J. Scott Glover; Mark D. Lippmann, both of Irving; T. Tony Nguyen, Dallas, all of Tex.

[73] Assignee: International Consumer Products, Dallas, Tex.

[21] Appl. No.: 718,613

[22] Filed: Jun. 21, 1991

[51] Int. Cl.[5] ..... A46B 11/02

[52] U.S. Cl. ..... 401/150; 401/176; 401/279; 401/280

[58] Field of Search ..... 401/146, 149, 150, 176, 401/279, 280

[56] References Cited

U.S. PATENT DOCUMENTS

| | | | |
|---|---|---|---|
| 1,049,863 | 1/1913 | Happle et al. . | |
| 1,563,190 | 11/1925 | House . | |
| 1,578,922 | 3/1926 | Sargery . | |
| 1,764,130 | 6/1930 | Vardeman . | |
| 1,860,911 | 5/1932 | Trimble . | |
| 1,908,511 | 5/1933 | Dodson . | |
| 2,000,910 | 5/1935 | Appel et al. | 15/137 |
| 2,172,624 | 9/1939 | Romani Y Robert | 15/167 |
| 2,259,928 | 10/1941 | Eaton | 15/136 |
| 2,268,928 | 1/1942 | Duey | 15/138 |
| 2,308,078 | 1/1943 | Hendrickson | 221/78 |
| 2,323,378 | 7/1943 | Champion et al. | 221/102 |
| 2,652,949 | 9/1953 | Martin | 222/95 |
| 2,774,981 | 12/1956 | Bonilla | 15/137 |
| 2,823,401 | 2/1958 | O'Higgins | 15/131.1 |
| 3,118,166 | 1/1964 | Bell | 15/531 |
| 3,383,157 | 5/1968 | Goldhirsh | 401/190 |
| 3,400,996 | 9/1968 | Vandergrift | 401/184 |
| 3,400,999 | 9/1968 | Goldstein | 401/278 |
| 3,864,047 | 2/1975 | Sherrod | 401/278 |
| 3,910,706 | 10/1975 | Del Bon | 401/134 |
| 3,936,200 | 2/1976 | O'Rourke | 401/184 |
| 3,937,235 | 2/1976 | Broughton | 132/84 B |
| 3,937,582 | 2/1976 | Del Bon | 401/134 |
| 4,068,974 | 1/1978 | Meyer et al. | 401/150 |
| 4,088,412 | 5/1978 | Del Bon | 401/151 |
| 4,135,831 | 1/1979 | Reitknecht | 401/175 |
| 4,201,490 | 5/1980 | D'Angelo | 401/175 |
| 4,221,492 | 9/1980 | Boscardin et al. | 401/184 |
| 4,269,207 | 5/1981 | Konrad et al. | 132/84 B |
| 4,521,128 | 6/1985 | O'Neal | 401/183 |
| 4,685,819 | 8/1987 | Endo | 401/176 |
| 4,695,177 | 9/1987 | Kuo | 401/150 |
| 4,787,765 | 11/1988 | Kuo | 401/150 X |
| 4,890,349 | 1/1990 | Nitzsche | 15/167.1 |

FOREIGN PATENT DOCUMENTS

| | | | |
|---|---|---|---|
| 123518 | 10/1984 | European Pat. Off. | 401/150 |
| 2152512 | 4/1972 | Fed. Rep. of Germany . | |
| 3514600 | 8/1986 | Fed. Rep. of Germany | 401/150 |
| 832415 | 9/1938 | France . | |
| 2438443 | 6/1980 | France | 401/150 |
| 729378 | 12/1966 | Italy . | |
| 267528 | 8/1927 | United Kingdom . | |

*Primary Examiner*—Steven A. Bratlie
*Attorney, Agent, or Firm*—Richards, Medlock & Andrews

[57] ABSTRACT

A toothbrush which dispenses paste has a hollow stem with a bristled head, open bottom and discharge aperture at the bristled head. A cartridge for containing the paste is attachable to the open bottom. A hollow pump piston is disposed in the hollow stem and is slidable between an open and closed position. A button extends through the stem and engages with the pump piston such that when the button is pressed, the pump piston simultaneously moves to the open position and dispenses paste and when the button is released, the pump piece simultaneously moves to the closed position and seals the toothpaste inside the toothbrush.

27 Claims, 2 Drawing Sheets

PASTE DISPENSING BRUSH

TECHNICAL FIELD OF THE INVENTION

This invention relates to a paste dispensing brush, and more particularly to a toothbrush with a paste cartridge and a means for dispensing paste from the cartridge onto the brush.

BACKGROUND OF THE INVENTION

Paste dispensing toothbrushes, such as those shown in U.S. Pat. No. 4,135,831 to Reitknecht, U.S. Pat. No. 4,269,207 to Konrad et al., and U.S. Pat. No. 4,201,490 to D'Angelo, are known in the prior art but have experienced only moderate success because of several limitations of their designs. A significant limitation of these designs is that they require, at a minimum, three steps to operate. Before these brushes can be used, the hole(s) opening into the bristles must be opened, a knob at the base of the brush must be turned to dispense toothpaste into the bristles and then finally the hole(s) must be closed again. These steps require multiple manipulations of the toothbrush thus making these brushes commercially undesirable compared to using inexpensive existing toothbrushes with a separate toothpaste container.

The prior paste dispensing toothbrushes generally dispense toothpaste by using a knob at the end of the brush which rotates a cylinder on a threaded shaft. This complicated mechanism consists of several parts, is expensive to manufacture and more prone to breaking. A need exists for a paste dispensing toothbrush which dispenses paste with an inexpensive, simpler, and easier to manufacture mechanism.

In designs which do not have a mechanical means for forcing the toothpaste from the paste container, such as those which have a collapsible paste container, the units do not provide for positive dispensing of the paste and are susceptible to inadvertent dispensing of paste such as when carried during traveling. Thus, a need exists for a paste dispensing toothbrush which overcomes the limitations found in the prior art designs.

SUMMARY OF THE INVENTION

The present invention provides a paste dispensing toothbrush which is easy to operate and requires fewer steps of operation than the traditional toothbrush or the prior paste dispensing toothbrushes. The toothbrush also dispenses the paste with a simple mechanism that is inexpensive and easy to manufacture. One aspect of the present invention is the combination of a hollow toothbrush and a pumping means to dispense paste onto the toothbrush. The toothbrush comprises a hollow stem with a removable bristled head, a base, and at least one discharge aperture in the bristled head. A cartridge for containing paste is adapted to attach to the base. A pumping means integral with the stem is provided which delivers paste from the cartridge to the bristled head.

In another aspect of the invention, a toothbrush which simultaneously delivers paste and seals the paste in the toothbrush is provided. A pump piston is disposed within the hollow stem and movable between a closed and open position. The pump piston has an upper end that blocks the discharge aperture in the bristled head when in the closed position and slides away from the discharge aperture when in the open position. The pump piston also has a piston disk disposed in the base that has a lower opening. The piston disk protrudes into the cartridge when the pump piston is in the open position. An actuation button extends through the stem and engages the pump piston such that pressing the actuation button moves the pump piston to the open position and extrudes the paste in the cartridge through the orifice of the lower opening of the piston disk, through the upper end and out the discharge aperture. Releasing the actuation button moves the pump piston back to the closed position closing off the discharge aperture.

With such a structure, toothpaste is dispensed into the bristles by pushing the actuation button. The actuation button can be located such that it is naturally reached by a user's thumb when the toothbrush is being grasped for normal use. In this way the toothbrush does not need to be manipulated in any way but only need be grasped and pumped by the thumb for use.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION

Figure 1:
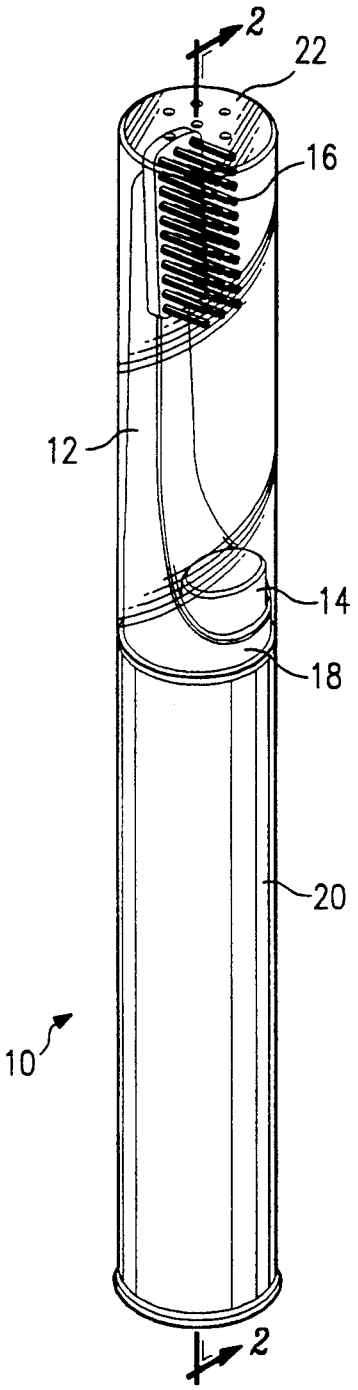
FIG. 1 is a perspective view of the preferred embodiment of the paste dispensing brush of the present invention.
Figure 2:
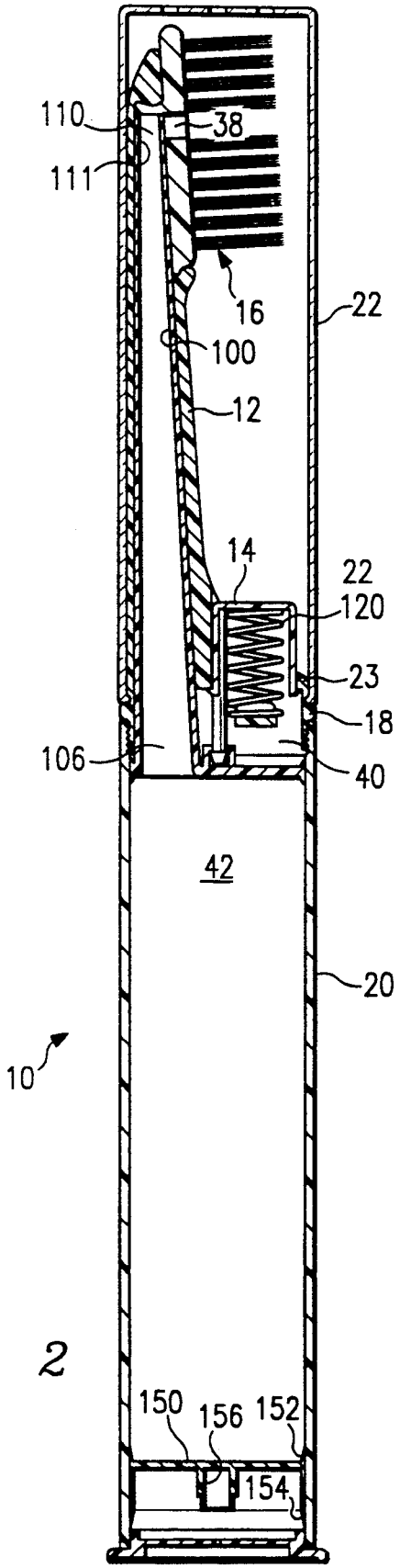
FIG. 2 is a vertical section taken along lines 2—2 of FIG. 1.

Referring now to the drawings, wherein like reference numerals designate like or corresponding parts throughout the several views, FIG. 1 illustrates the preferred embodiment of the paste dispensing brush unit 10 according to the present invention. Brush unit 10 includes a hollow stem 12 with a bristled head 16 removably attached to one end thereof. Stem 12 has an actuation button 14 integrated into its base 18. Base 18 engages and is removably attached to a paste cartridge 20. A transparent cap 22 fits over stem 12 and bristled head 16 and snaps on base 18. Referring to FIG. 2, cap 22 removably engages lip 23 formed on base 18.

Figure 3:
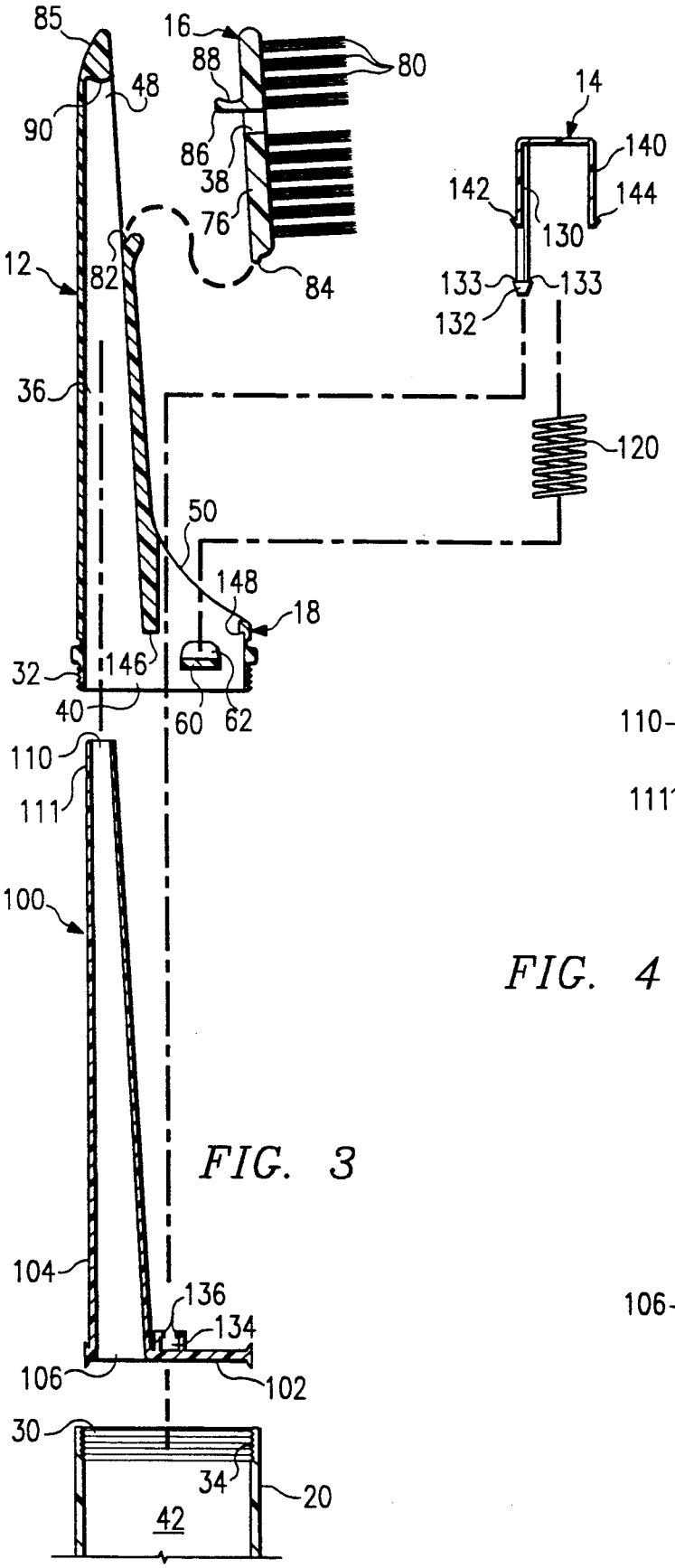
FIG. 3 is an exploded view of the top half of FIG. 2.

With reference to FIGS. 2 and 3, the preferred construction of the present invention and its components is shown. Base 18 of hollow stem 12 has male threads 32 which are threadedly received into female threads 34 in open top end 30 of cartridge 20. As can be seen in FIG. 3, stem 12 has a conical bore 36 therein defining a bottom opening 40 in its base which communicates with the paste chamber 42 defined by cartridge 20. Stem 12 has an opening 48 in its upper end for receiving the bristled head 16 and a opening 50 for receiving actuation button 14. A spring support shelf 60 is formed within stem 12 and has a spring alignment shaft 62 extending therefrom.

Referring now to the brush unit 10 and its attachment to stem 12, as is seen in FIG. 3, bristled head 16 has a base 76 with a discharge aperture 38 therein. Base 76 receives a plurality of brush bristles 80 which are disposed over substantially the entire area of the base. The opening 48 in the upper end of hollow stem 12 is designed to removably receive head 16. This is achieved by providing a seat 82 for receiving the lower end 84 of base 76. A tab 86 extends from base 76 of head 16 and has a contoured seat 88 which corresponds to and mates with a downwardly protruding contour 90 formed in the upper end 85 of stem 12. Tab 86 is somewhat flexible so as to provide a snap fit of the tab beyond contour 90 and into head 16 as shown in FIG. 2.

When head 16 is in the attached position as shown in FIG. 2, it substantially fully covers the opening 48 and its aperture 38 is adjacent the upper extremity of the bore 36 formed in the stem 12.

As is seen in FIG. 3, a pump piston 100 is received within stem 12 and has a piston disk 102 with a conical neck 104 extending therefrom. The piston 100 has a lower opening 106 through disk 102 which feeds into neck 104. The neck has an upper opening 110. In its at-rest position, as shown in FIG. 2, neck 104 has an outer contour which substantially corresponds to the interior contour of stem 12 such that it will nest therein. Upper end 111 of neck 104 also sealingly engages tab 86 in its at-rest position. In the preferred embodiment, pump piston 100 has a circular or oval cross-section to match hollow stem 12. However, pump piston 100 can have a partial cross-section such as semi-circular or semi-oval, and long as upper end 111 is wide enough to seal across opening 48.

In the preferred embodiment, pump piston 100 also has flange 108 around the periphery of piston disk 102 to sealingly contact the inside surfaces of base 18 and cartridge 20.

As can be seen in FIGS. 2 and 3, button 14 is connected to piston 100 with a spring 120 trapped between the interior of the button 14 and shelf 60. Spring 120 is aligned along shelf 60 by engagement around shaft 62. Button 14 has a back wall 130 having a conical head 132 for snapping engagement into a receiving bore 134 with inturned ears 136 for engaging the upper flared ends 133 of the conical head 132. As can be seen, this design allows the head 132 to be snapped into and captured by bore 134 on disk 102 to connect the button to the disk 102. At the same time, button 14 has outwardly facing tabs 142 and 144, respectively, on its back wall 130 and front wall 140 which engage the lowermost end 146 of stem 12 and inturned ledge 148, respectively. This structure prevents the button 14 from being forced upwardly and out of opening 50 in stem 12.

This geometrically positions piston 100, at rest, at its uppermost position by the action of spring 120 acting between the interior of button 14 and shelf 60. The connection of button 14 to disk 102 also results in the piston 100 being urged by spring 120 to the up position shown in FIG. 2.

With reference to FIG. 2, a backup piston 150 is positioned within the paste cartridge on the side of the paste supply opposite pump piston 100. Backup piston 150 is designed with resilient upper and lower flanges 152 and 154 extending from a piston body. A centrally located annular flange 156, having a substantially smaller diameter than piston 150, extends downwardly from the piston 150. Upper flange 152 and lower flange 154 are designed to allow the backup piston 150 to move upwardly in the cartridge 20 but to resist movement downwardly. This is accomplished by the angle of the flanges and by a very slight tapering of the inside of cartridge 20 such that the diameter of cartridge 20 increases very slightly towards open top end 30. In an alternative embodiment, a metal ring can be attached about the periphery of one or both flanges that will bite into the inside wall of cartridge 20 to resist downward movement. In the preferred embodiment, these backup piston flanges are made from a polypropylene material.

Figure 4:
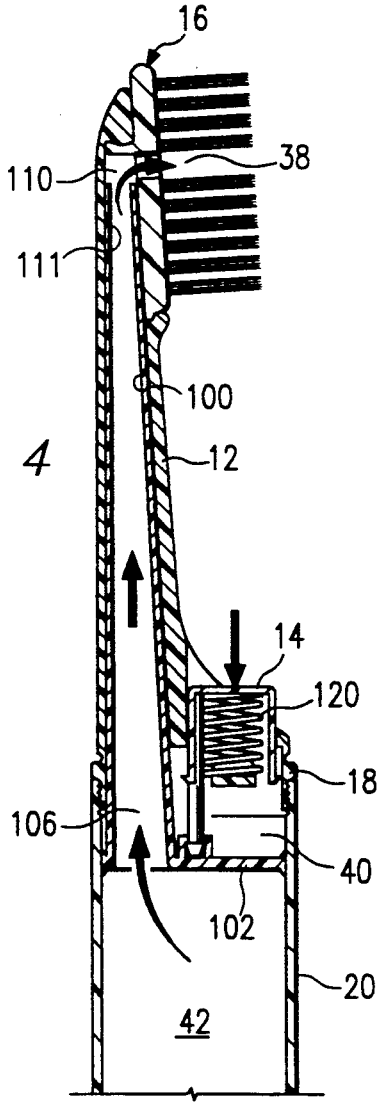
FIG. 4 is a partial vertical section showing the paste dispensing brush in the open position during a pump stroke.

Referring to FIGS. 2 and 4, the operation of the paste dispensing brush is illustrated. Pump piston 100 is movable between a closed position (FIG. 2) and an open position (FIG. 4). Upper end 111 blocks aperture 38 when pump piston 100 is in the closed position. In the open position, upper end 111 slides down and exposes aperture 38 to end opening 110. Piston disk 102 is at the base 18 while pump piston 100 is in closed position, and when the pump piston 100 is moved to the open position, piston disk 02 moves into paste chamber 42 of cartridge 20.

To discharge toothpaste to head 16, button 14 is pressed and moves pump piston 100 downwardly, extruding paste from paste chamber 42 through lower opening 106, through upper opening 110 and out aperture 38. When button 14 is released, spring 120 forces button 14 upwardly which moves pump piston 100 back to the closed position to close aperture 38.

Referring to FIG. 2, as button 14 springs back and moves pump piston 100 to the closed position, paste is drawn up towards base 18 by the upward movement of piston disk 102, which in turns pulls backup piston 150 upwardly inside cartridge 20. In view of its design, backup piston 150 resists moving downwardly and thus facilitates extrusion of paste the next time button 14 is pressed by keeping the paste within the area of lower opening 106 of pump piston 100.

It should be noticed that the conical contour of neck 104 and bore 36 also assure a close seal at upper end 111. Because of the conical nature of the design of these two pieces, as the neck 104 is moved downwardly, more clearance is provided to facilitate this action, and as it moves up, a sealingly engagement is provided.

Another aspect of the invention is the placement of button 14 on brush unit 10. The button 14 is located at base 18 of stem 12 sufficiently away from the bristled head 16 so as to not interfere with brushing. Button 14 is also located on base 18 such that when brush unit 10 is grasped, the user's thumb can be naturally positioned over button 14 before and during brushing.

The present invention provides several advantages. First, the invention provides a toothbrush with its own paste cartridge such that paste can be dispensed by simply depressing a button that is conveniently positioned immediately below the brush unit. This positioning of the button 14 is not only convenient, it allows the unit to have a compact design to facilitate its use not only in the usual course but for travel as well. Additionally, the unit provides a design wherein the paste is extruded upon actuation but where the paste is closed from the atmosphere and other contaminants when the unit is in the at-rest position. Thus, there is no possibility for the paste to be contaminated or to dry out as in prior designs. At the same time, use of the product is convenient in that no cap, like on conventional toothpaste tubes, or valve, like on prior art fountain brushes, must be opened or removed before use. Thus, both convenience and hygienic conditions are assured.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. A brush that dispenses extrudable material, comprising:

a stem having a first end portion and a second end portion, a head attached to said second end portion of said stem, said head having bristles extending therefrom, said head having at least one discharge aperture therein adjacent to said bristles, said stem having a tapered bore therein extending from said first end portion towards said second end portion so as to communicate with said at least one discharge aperture, the largest diameter of said tapered bore being at said first end portion of said stem, said first end portion of said stem being adapted to have secured thereto a cartridge for containing extrudable material wherein the cartridge has a first end and a second end with the second end of the cartridge being attachable to said first end portion of said stem;

a pump for delivery of extrudable material from said cartridge to said at least one discharge aperture and onto said bristles, said pump comprising:

(a) a tapered piston having a first end portion and a second end portion, said tapered piston having a passageway therethrough extending from said first end portion of said tapered piston to said second end portion of said tapered piston, said tapered piston being disposed within said tapered bore and having an outer contour which at least substantially corresponds to the contour of said tapered bore such that said tapered piston will nest in said tapered bore, said tapered piston being movable along said tapered bore between a closed position and an opened position, said passageway and said at least one discharge aperture being in communication with each other when said tapered piston is in said opened position, the communication between said passageway and said at least one discharge aperture being blocked when said tapered piston is in said closed position;

(b) a piston disk having an orifice extending therethrough, said piston disk being attached to said first end portion of said tapered piston with said orifice providing communication between said passageway and a cartridge when the second end of a cartridge is attached to said first end portion of said stem; and (c) a button associated with said piston disk such that pressing said button moves said tapered piston to said opened position and moves said piston disk towards the first end of a cartridge, when the second end of a cartridge is attached to said first end portion of said stem, to extrude extrudable material from the cartridge through said orifice of said piston disk, through said passageway, and through said at least one discharge aperture, and releasing said button moves said tapered piston to said closed position and moves said piston disk away from the first end of a cartridge when the second end of a cartridge is attached to said first end portion of said stem.

2. A brush in accordance with claim 1 wherein said pump is integral with said stem, and wherein said piston disk has a flange around the periphery of said piston disk to sealingly contact the inside surface of a cartridge when the second end of a cartridge is attached to said first end portion of said stem.

3. A brush in accordance with claim 1 wherein said button is located on said stem such that when said brush is grasped by a user for the purpose of brushing the user's teeth, the thumb of the user c an be easily positioned over said button before and during the use of the brush to brush the user's teeth.

4. A brush in accordance with claim 1 further comprising a cartridge for containing extrudable material and having a first end and a second end, with said second end of said cartridge being attached to said first end portion of said stem.

5. A brush in accordance with claim 4 wherein the inside of said cartridge is tapered such that the inner diameter of said cartridge increases from said first end of said cartridge towards said second end of said cartridge.

6. A brush in accordance with claim 4 further comprising a backup piston slidably disposed in said cartridge, said backup piston having circumferential flanges which permit said backup piston to slide towards said second end of said cartridge as material is extruded from said cartridge to said at least one discharge aperture and which resist movement of said backup piston towards said first end of said cartridge.

7. A brush in accordance with claim 6 wherein one of said circumferential flanges extends from said backup piston towards said first end of said cartridge and another of said circumferential flanges extends from said backup piston towards said second end of said cartridge.

8. A brush in accordance with claim 6 further comprising a centrally located annular flange, having a substantially smaller diameter than said backup piston, extending from said backup piston towards said first end of said cartridge.

9. A brush in accordance with claim 1 wherein said head is removably attachable to said stem.

10. A brush in accordance with claim 1 wherein said tapered bore comprises a conical bore, and wherein said tapered piston comprises a conical piston which has an outer contour which conforms to the contour of said conical bore.

11. A brush in accordance with claim 1 further comprising a spring disposed between said stem and an underside of said button such that said spring acts to return said button to an at-rest position when said button is released.

12. A brush in accordance with claim 11 wherein said second end portion of said stem has a closed end, wherein said stem has an opening adjacent to said closed end so as to communicate with said tapered bore, wherein said head has a first end and a second end and a first side and a second side with said bristles extending from said second side, wherein said at least one discharge aperture extends from said first side of said head to said second side of said head adjacent to said bristles, wherein said head has a flexible tab extending outwardly from said first side of said head and adapted to engage said stem to provide a snap-fit attachment of said head to said stem such that said head at lest substantially fully covers said opening in said stem so that said at least on discharge aperture is in communication with said tapered bore.

13. A brush in accordance with claim 12 wherein said opening in said stem has first and second ends, wherein said stem has a contour formed adjacent to said first end of said opening in said stem so as to correspond to and mate with said flexible tab, and wherein first end of said head engages said stem adjacent said second end of said opening in said stem to thereby provide, in cooperation with said flexible tab and said contour, said snap-fit attachment of said head to said stem.

14. A brush in accordance with claim 11 wherein said first end portion of said stem constitutes a base, wherein said button is mounted in said base so as to have a depressed position and an at-rest position, said base having a spring support, a spring positioned between said spring support and said button to urge said button to said at-rest position, said button having tabs thereon to engage said base to retain said button in said base, an element connecting said button to said piston disk such that depressing said button moves said tapered piston to said opened position and moves said piston disk towards the first end of a cartridge, when the second end of a cartridge is attached to said first end portion of said stem, to extrude extrudable material from the cartridge through said orifice of said piston disk, through said passageway, and through said at least one discharge aperture, and releasing said button moves said tapered piston to said closed position and moves said piston disk away from the first end of a cartridge when the second end of a cartridge is attached to said first end portion of said stem.

15. A brush in accordance with claim 14 wherein said button is located in said base such that when said brush is grasped by a user for the purpose of brushing the user's teeth, the thumb of the user can be easily positioned over said button before and during the use of the brush to brush the user's teeth, with the movement of said button between its depressed position and its at-rest position being at least generally parallel to the longitudinal axis of said stem.

16. A brush in accordance with claim 14 further comprising a cartridge for containing extrudable material and having a first end and a second end, with said second end of said cartridge being attached to said first end portion of said stem; and a backup piston slidably disposed in said cartridge, said backup piston having circumferential flanges which permit said backup piston to slide towards said second end of said cartridge as material is extruded from said cartridge to said at least one discharge aperture and which resist movement of said backup piston towards said first end of said cartridge.

17. A brush in accordance with claim 16 wherein the inside of said cartridge is tapered slightly such that the inner diameter of said cartridge increases from said first end of said cartridge towards said second end of said cartridge.

18. A brush in accordance with claim 16 wherein one of said circumferential flanges extends from said backup piston towards said first end of said cartridge and another of said circumferential flanges extends from said backup piston towards said second end of said cartridge.

19. A brush in accordance with claim 14 wherein said head is removably attachable to said stem.

20. A brush in accordance with claim 14 wherein said tapered bore comprises a conical bore, and wherein said tapered piston comprises a conical piston which has an outer contour which conforms to the contour of said conical bore.

21. A brush in accordance with claim 14 wherein said tapered bore comprises a conical bore, and wherein said tapered piston comprises a conical piston which has an outer contour which only partially conforms to the contour of said conical bore.

22. A brush in accordance with claim 14 wherein said second end portion of said stem has a closed end, wherein said stem has an opening adjacent to said closed end so as to communicate with said tapered bore, wherein said head has a first end and a second end and a first side and a second side with said bristles extending from said second side of said head, wherein said at least one discharge aperture extends from said first side of said head to said second side of said head adjacent to said bristles, wherein said head has a flexible tab extending outwardly from said first side of said head and adapted to engage said stem to provide a snap-fit attachment of said head to said stem such that said head at least substantially fully covers said opening in said stem so that said at least one discharge aperture is in communication with said tapered bore.

23. A brush in accordance with claim 20 wherein said opening in said stem has first and second ends, wherein said stem has a contour formed adjacent to said first end of said opening in said stem so as to correspond to and mate with said flexible tab, and wherein first end of said head engages said stem adjacent said second end of said opening in said stem to thereby provide, in cooperation with said flexible tab and said contour, said snap-fit attachment of said head to said stem.

24. A brush in accordance with claim 23 wherein said second end portion of said tapered piston sealingly engages said flexible tab against said contour when said tapered piston is in said closed position, to thereby block communication between said passageway and said at least one discharge aperture.

25. A brush in accordance with claim 14 wherein said button has a hollow formed therein, and wherein said spring is at least partially positioned within said hollow of said button.

26. A brush in accordance with claim 14 wherein the central portion of said piston disk has a receiving bore with inturned ears, and wherein said element has an enlarged end thereon which is snap-engaged into said receiving bore to connect said button to said piston disk.

27. A brush in accordance with claim 1 further comprising a cap which fits over said head and said second end portion of said stem and is removably secured to said first end portion of said stem.

* * * * *

UNITED STATES PATENT AND TRADEMARK OFFICE

CERTIFICATE OF CORRECTION

PATENT NO. : 5,158,383

DATED : October 27, 1992

INVENTOR(S) : J. Scott Glover et al

It is certified that error appears in the above-identified patent and that said Letters Patent is hereby corrected as shown below:

Column 4, line 13, change "disk 02" to --disk 102--.

Column 6, line 7, change "c an" to --can--.

Column 6, line 51, change "claim 11" to --claim 1--.

Column 6, line 63, change "lest" to --least--.

Column 6, line 65, change "on" to --one--.

Column 7, line 8, change "claim 11" to --claim 1--.

Column 8, line 31, change "claim 20" to --claim 22--.

Signed and Sealed this

Twenty-ninth Day of March, 1994

*Attest:*

Bruce Lehman

BRUCE LEHMAN

*Attesting Officer*

*Commissioner of Patents and Trademarks*